US009328510B1

(12) United States Patent
Springer et al.

(10) Patent No.: US 9,328,510 B1
(45) Date of Patent: May 3, 2016

(54) CEILING SYSTEM

(71) Applicant: ARMSTRONG WORLD INDUSTRIES, INC., Lancaster, PA (US)

(72) Inventors: Brian L. Springer, Lancaster, PA (US); Nathan J. Baxter, Lancaster, PA (US); G. Douglas Vernau, Mountville, PA (US); Ryan D. Hanuschak, Lancaster, PA (US)

(73) Assignee: AWI Licensing Company, Wilmington, DE (US)

( * ) Notice: Subject to any disclaimer, the term of this patent is extended or adjusted under 35 U.S.C. 154(b) by 0 days.

(21) Appl. No.: 14/793,105

(22) Filed: Jul. 7, 2015

(51) Int. Cl.

| | |
|---|---|
| ***E04B 9/28*** | (2006.01) |
| ***E04B 9/04*** | (2006.01) |
| ***E04B 9/06*** | (2006.01) |
| ***E04B 9/24*** | (2006.01) |

(52) U.S. Cl.
CPC ..... *E04B 9/28* (2013.01); *E04B 9/0435* (2013.01); *E04B 9/067* (2013.01); *E04B 9/241* (2013.01)

(58) Field of Classification Search
CPC ..... E04B 9/0435; E04B 9/0464; E04B 9/067; E04B 9/068; E04B 9/22; E04B 9/24; E04B 9/241; E04B 9/28
USPC ..... 52/506.07, 506.08, 506.09, 510
See application file for complete search history.

(56) References Cited

U.S. PATENT DOCUMENTS

| | | | | | |
|---|---|---|---|---|---|
| 419,388 | A | * | 1/1890 | White et al. | E04B 9/26 110/173 R |
| 2,161,185 | A | * | 6/1939 | Mills | E04B 2/58 24/370 |
| 2,736,929 | A | | 3/1956 | Nies et al. | |
| 4,356,677 | A | * | 11/1982 | Mosch | E04B 9/26 52/506.08 |
| 4,546,587 | A | * | 10/1985 | Mosch | E04B 9/26 52/506.08 |
| 4,615,448 | A | * | 10/1986 | Johnstonbaugh | A47F 5/0846 211/189 |
| 4,856,245 | A | * | 8/1989 | Osawa | E04F 13/0832 52/386 |
| 5,165,209 | A | * | 11/1992 | Bischel | E04B 9/0407 52/287.1 |

(Continued)

FOREIGN PATENT DOCUMENTS

| | | | |
|---|---|---|---|
| FR | 2202999 | | 10/1972 |
| JP | 4-9706103 | A * | 3/1992 |
| WO | 90/15204 | | 12/1990 |

*Primary Examiner* — Robert Canfield
(74) *Attorney, Agent, or Firm* — Craig M. Sterner

(57) ABSTRACT

A ceiling system in one embodiment includes ceiling panels configured for attachment to an overhead support grid. The ceiling panel includes profiled first and second edges that engage parallel first and second grid support members respectively. At least one intermediate channel is formed in the top surface between the first and second edges. The channel defines a seating surface that engages a third grid support member arranged parallel to and between the first and second grid support members. The central portion of the ceiling panel is supported in a manner which allows the panel to span across and cover at least two grid openings, thereby providing a ceiling system that utilizes large format panels exceeding the size of the openings.

12 Claims, 10 Drawing Sheets

(56) References Cited

U.S. PATENT DOCUMENTS 6,108,994 A * 8/2000 Bodine ..... E04B 9/28 52/506.07
6,199,337 B1 * 3/2001 Colson ..... E04B 9/00 160/327
6,230,463 B1 * 5/2001 Bodine ..... E04B 9/28 52/506.07
6,260,325 B1 * 7/2001 Wendt ..... E04B 9/068 52/489.2
6,427,409 B2 * 8/2002 Colson ..... E04B 9/00 160/84.05
7,240,460 B2 7/2007 Platt
7,681,370 B2 * 3/2010 Waters ..... E04B 9/127 52/506.07
7,712,274 B2 * 5/2010 Wendt ..... E04B 9/003 52/377
7,908,813 B2 * 3/2011 Gulbrandsen ..... E04B 9/0414 52/506.07
D673,402 S * 1/2013 Kuzyk ..... D6/703
2009/0173030 A1 * 7/2009 Gulbrandsen ..... E04B 9/0414 52/506.09
2010/0269444 A1 * 10/2010 Gulbrandsen ..... E04B 9/0414 52/506.09
2015/0027075 A1 * 1/2015 Wilkens ..... E04B 9/0435 52/385
2015/0211231 A1 * 7/2015 Bergman ..... E04B 9/0435 52/489.1

* cited by examiner

CEILING SYSTEM

FIELD

The present invention relates to ceiling systems, and more particularly to a suspended ceiling system.

BACKGROUND

Many types of suspended ceiling systems and methods for mounting ceiling panels have been used. One type of system uses a suspended metal support grid including an array of orthogonally intersecting grid support members. An array of grid openings are formed between the grid support members which are closed by the ceiling panels. Ceiling panels have been mounted to and supported by the support grid using numerous approaches. Typically, the size of the individual ceiling panels usable in such support grids has been limited and substantially coextensive with the size of the grid openings resulting in the creation of numerous visible seams. Furthermore, these ceiling panel size limitations also make it difficult to use the panels in a concealed ceiling system which hides the support grid from room occupants below.

Accordingly, an improved system and method for supporting ceiling panels for use in a concealed ceiling system is desired.

SUMMARY

A ceiling system according to the present disclosure provides large format ceiling panels that dimensionally exceed the spacing of the overhead grid support members (e.g. large format panels). The ceiling panel is therefore dimensioned to span across at least one intermediate grid support member between opposing ends or sides of the panel. In some non-limiting examples, the ceiling panels may be 4×4 ft., 4×6 ft., 4×8 ft., or larger. Other sizes may be used.

Advantageously, each large format ceiling panel may therefore replace the use of several smaller panels to cover an equivalent ceiling area, which minimizes visible seams in addition to concealing the grid face. In addition, the installation of a fewer number of large format panels reduces installation time and costs. The ceiling panels according to the present disclosure are readily adaptable for retrofit to existing support grids to eliminate costly replacement of the grid in order to accommodate large format panels. The ceiling panels therefore utilize the existing room grid or a new grid for new installations in a manner that is removable for ready access to utilities above the ceiling system and downward accessible from the room space below.

In certain implementations, the present ceiling panels may further be supported by and are configured to engage the grid support members in a manner that substantially conceals the grid face of the support grid, thereby producing a monolithic ceiling appearance.

In one aspect, a suspended ceiling system includes: a ceiling support grid comprising a plurality of intersecting grid support members forming openings between the grid support members; a plurality of ceiling panels mounted to the grid support members of the support grid, each ceiling panel having a top surface and covering at least two openings, each ceiling panel further comprising profiled first and second edges that engage parallel first and second grid support members respectively and at least one intermediate channel in the top surface between the first and second edges, the intermediate channel defining a seating surface that engages a third grid support member arranged parallel to and between the first and second grid support members.

In another aspect, a ceiling panel for a suspended ceiling system includes: a top surface; a bottom surface; a first peripheral edge extending between the top and bottom surfaces, the first peripheral edge having a first edge detail defining a first surface configured to engage a first grid support member for support; a second peripheral edge extending between the top and bottom surfaces, the second peripheral edge arranged opposite to the first peripheral edge and having a second edge detail defining a second surface configured to engage a second grid support member for support; and an intermediate channel formed in the top surface of the ceiling panel between the first and second peripheral edges, the intermediate channel defining a third surface configured to engage a third grid support member for support.

A method for mounting a ceiling panel in a suspended ceiling system is provided. The method includes: providing a support grid including first, second, and third grid support members arranged in parallel relationship, the third grid support member disposed between the first and second grid support members; engaging a first edge of a ceiling panel with the first grid support member by moving the ceiling panel in a first axial direction; pivoting the ceiling panel about the first edge; raising a second edge of the ceiling panel opposite the first edge upwards to engage the second grid support member; inserting the third grid support member into an elongated channel formed in a top surface of the ceiling panel between the first and second edges; sliding the ceiling panel in a second axial direction opposite to the first axial direction; and lockingly engaging a downward facing seating surface defined by each of the first edge, second edge, and channel with the first, second, and third grid support members respectively, wherein the ceiling panel cannot be vertically withdrawn from the support grid.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention

BRIEF DESCRIPTION OF THE DRAWINGS

The present invention will become more fully understood from the detailed description and the accompanying drawings, wherein.

Figure 1:
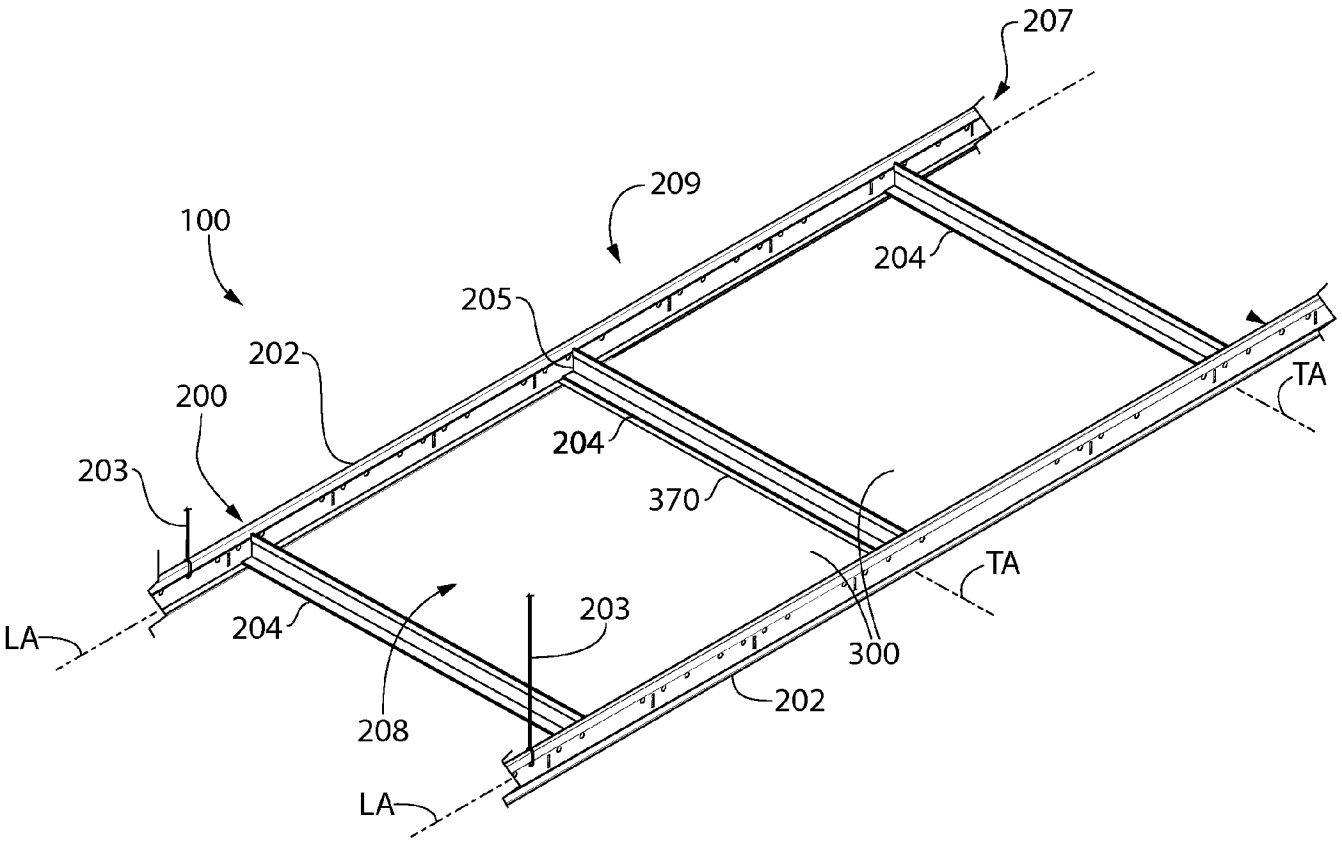
FIG. 1 is a perspective view of a ceiling system including a suspended support grid formed by intersecting grid support members and a ceiling panel mounted therein.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The following description of the preferred embodiment(s) is merely exemplary in nature and is in no way intended to limit the invention, its application, or uses In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

The present ceiling system 100 will now be described for convenience without limitation to a suspended type ceiling system having a grid-type ceiling panel support system which is hung from an overhead building structure.

Figure 2:
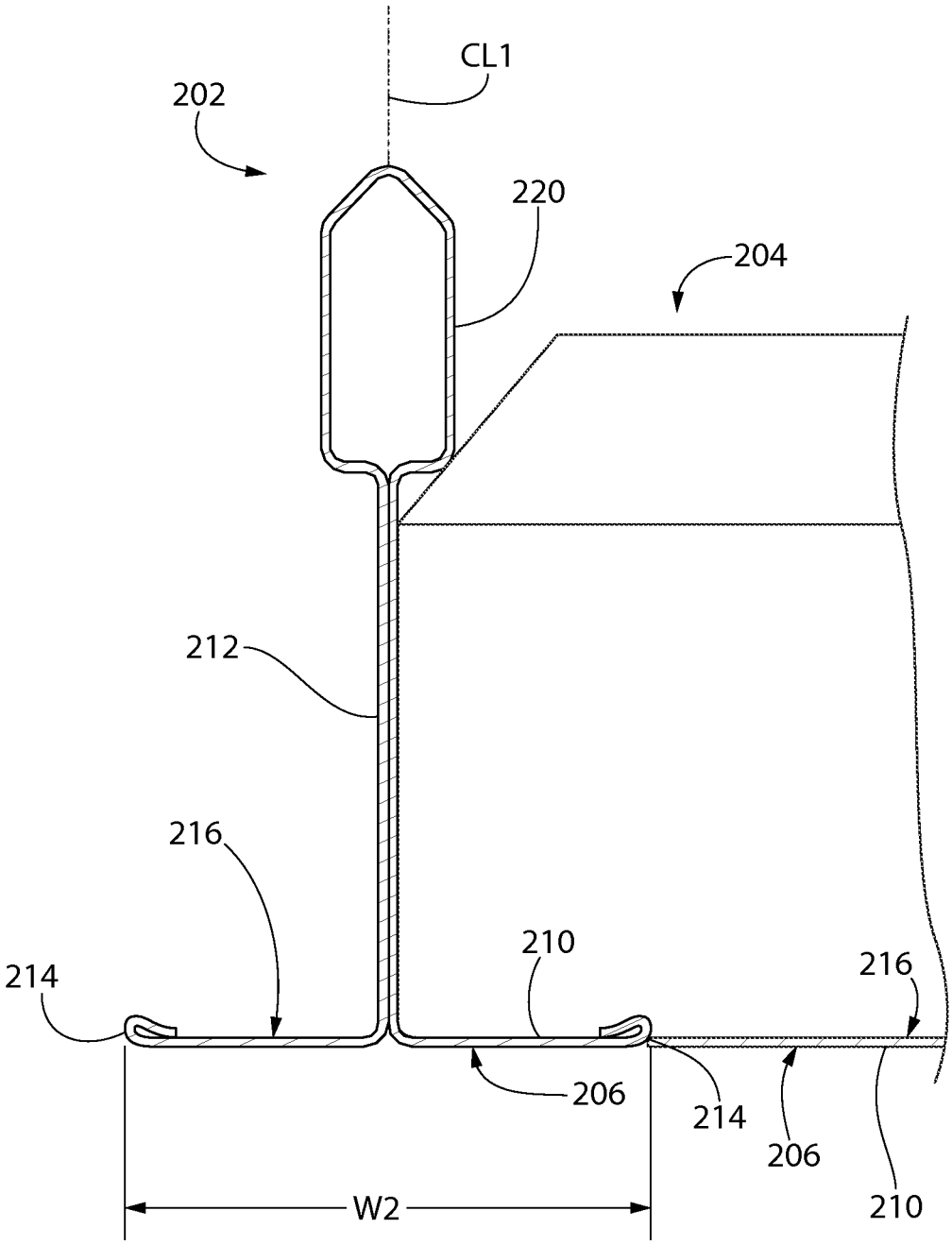
FIG. 2 (PRIOR ART)
FIG. 2 is a side cross-sectional view of an intersecting longitudinal and lateral grid support members.

Referring initially now to FIGS. 1 and 2, the ceiling system 100 generally includes an overhead grid support system 200 forming a ceiling support structure for mounting a plurality of ceiling tiles or panels. In one embodiment, the grid support system 200 may be configured for mounting in a suspended manner from an overhead building structure via appropriate hanger elements 203, such as for example without limitation fasteners, hangers, wires, cables, rods, struts, etc. Grid support system 200 defines a support grid 209 comprising a plurality intersecting longitudinal grid support members 202 (e.g. main beams or runners) and lateral grid support members 204 (e.g. cross tees). The longitudinal grid support members 202 may be referred to as main beams because these grid members in some embodiments alone may be hung by hanger elements 203 from an overhead building structure, thereby providing support for the entire grid. The lateral grid support members 204 may be referred to as cross tees because these grid members are generally but not necessarily supported only by the longitudinal grid support members 202 without direct attachment to the overhead structure.

Longitudinal and lateral grid support members 202, 204 are elongated in shape having a length greater than their respective width (e.g. at least twice), and in various embodiments lengths substantially greater than their widths (e.g. 3 times or more). Longitudinal grid support member 202 may have a substantially greater length than lateral grid support member 204 and form "runners" or "rails" which are maintained in a substantially parallel spaced apart relationship by the lateral grid support members. The lateral grid support members 204 may be attached to and between adjacent (but spaced apart) longitudinal grid support members 202 at appropriate intervals using any suitable permanent or detachable coupling means. The combination of interconnected longitudinal and lateral grid support members 202, 204 provides strength and lateral stability to the grid support system 200. In one non-limiting example, the grid support system 200 may be a Prelude® XL® grid available from Armstrong World Industries or another intermediate-duty or heavy-duty suspended grid system.

In one embodiment, grid support members 202 and 204 may be horizontally oriented when installed. It will be appreciated, however, that other suitable mounted orientations of grid support members 202, 204 such as angled or sloped (i.e. between 0 and 90 degrees to horizontal) may be used. Accordingly, although support members 202, 204 may be described in one exemplary orientation herein as horizontal, the invention is not limited to this orientation alone and other orientations may be used.

Longitudinal and lateral grid support members 202, 204 intersect to form an array of grid openings 208 which receive and essentially are closed by ceiling tiles or panels 300 when positioned within the openings. In some embodiments, the grid support members 202, 204 may be arranged in an orthogonal pattern wherein the support members intersect at right angles (i.e. perpendicular) to form rectilinear grid openings 208 such as squares or rectangles (in top plan view).

Figure 7:
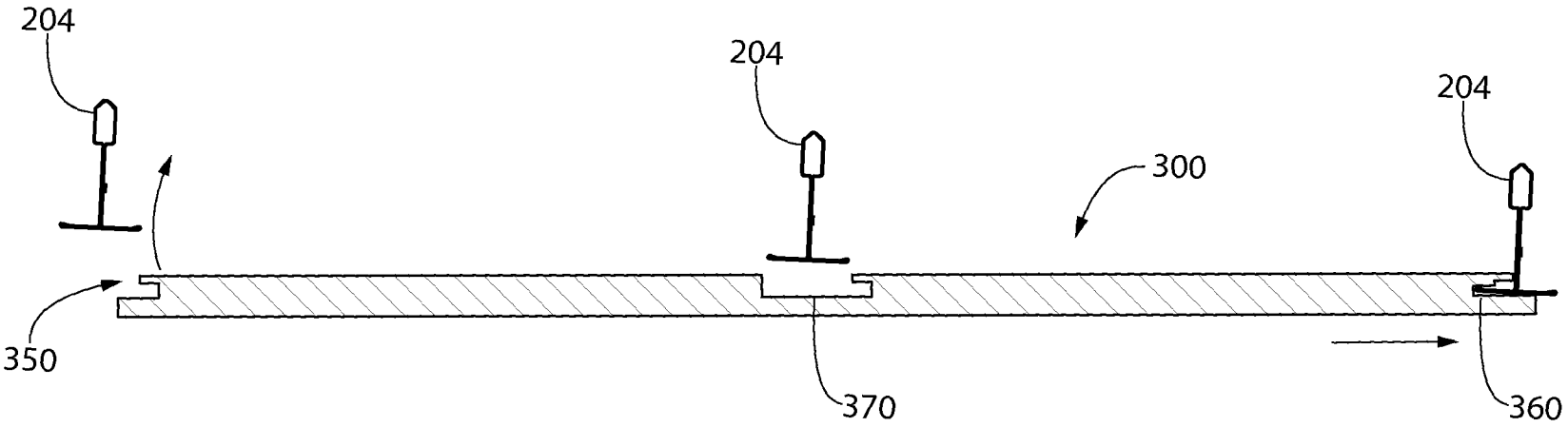
FIGS. 7-9 are sequential side cross-sectional views of the ceiling panel showing a process for mounting the ceiling panel to the grid support members.

The terminal ends 205 of the lateral grid support members 204 have end connections configured for permanent or detachable connection to the vertical webs 212 of the longitudinal grid support members 202 at right angles to form a rectilinear grid pattern (see, e.g. FIGS. 2 and 7). Non-limiting examples of suitable connection means include permanent connection such as without limitation welding, soldering, etc., or detachable connection such as without limitation clips, brackets, threaded fasteners, interlocking tabs/slots, etc. Accordingly, the present invention is not limited by the manner of attachment or coupling used. The terminal ends 207 of the longitudinal grid support members 202 have end connections configured for permanent or detachable end-to-end connection to the terminal ends of adjoining longitudinal grid support member to form continuous spans of the main beams (see, e.g. FIGS. 2 and 7). Similar permanent or detachable end connection means as those described above may be used.

It will be appreciated that some lateral grid support members 204 may be run the same direction between and parallel to main beam longitudinal grid support members 202, as shown for example in FIG. 1. Accordingly, the lateral grid support members 204 are not limited in their use to only arrangement at right angles to the longitudinal grid support members 202.

FIG. 2 is a transverse cross-sectional view of a longitudinal grid support member 202 and intersecting lateral grid support member 204 having a similar but not necessarily identical configuration. Referring to FIGS. 1 and 2, grid support members 202 and 204 may be T-shaped (e.g. T-rails) in transverse cross section. The grid support members have an inverted T-shaped configuration in an installed position suspended from an overhead building structure. Grid support members 202, 204 may each include a longitudinally-extending horizontal bottom flange 210, enlarged top stiffening channel 220, and vertical web 212 extending upwards from the flange to the stiffening channel. In some embodiments, the top stiffening channel 220 may be omitted from grid support members 202 and/or 204.

The longitudinal grid support members 202 each define a respective longitudinal axis LA. The lateral grid support members 204 generally but not necessarily are arranged transversely thereto the longitudinal grid support members 202 and define respectively define a transverse axis TA for each lateral grid support member. In one implementation, bottom flange 210 is oriented substantially horizontally when in an installed hung position (see, e.g. FIGS. 7 and 8) and has opposing portions which extend laterally outwards from web 212 and terminate in opposed axially extending longitudinal edges 214. Web 212 may be centered between the edges 214 and vertically aligned with the vertical centerline CL1 of the grid support member in some embodiments. In other embodiments, the web 212 may be laterally offset from centerline CL1 of the grid support member 202 or 204 including being substantially aligned with one longitudinal edge 214 of the grid support member 202 or 204 forming a structural angle shape.

Figure 3:
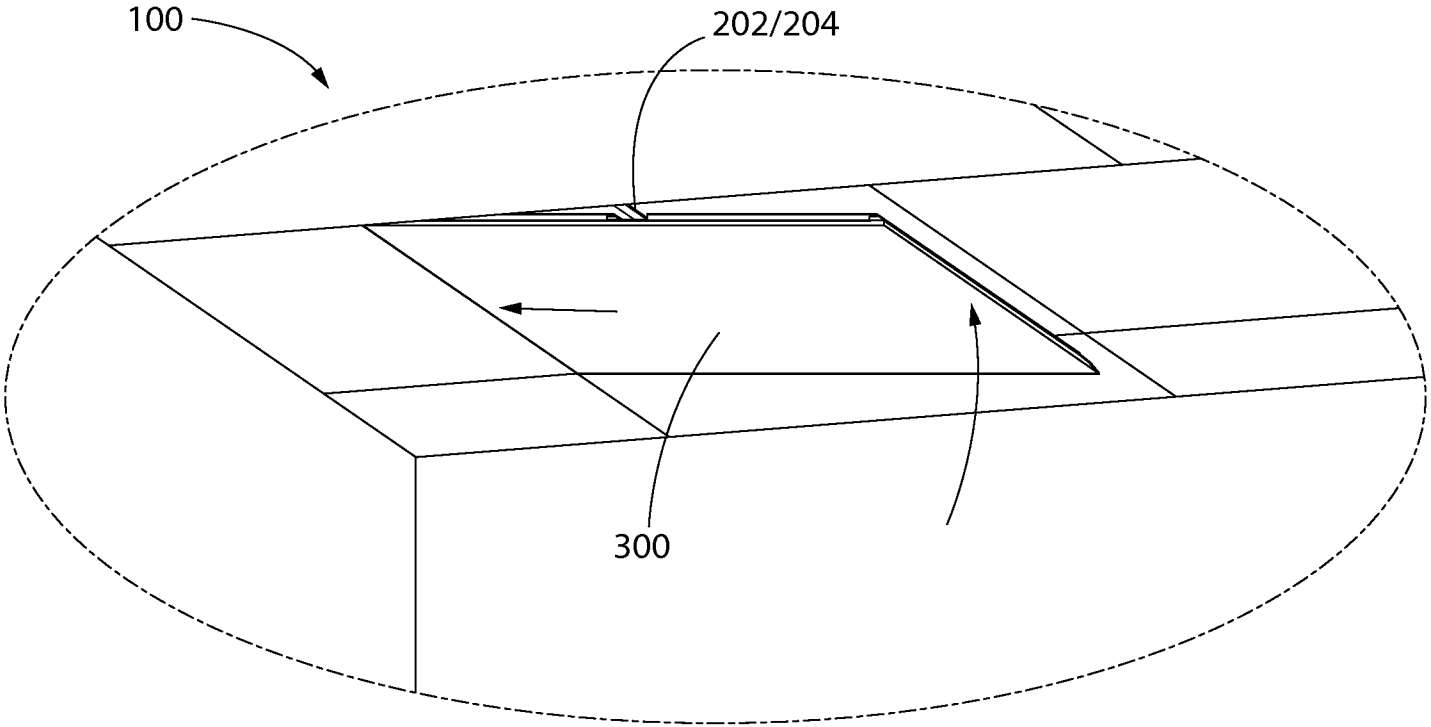
FIG. 3 is a bottom perspective view the ceiling system.

With continuing reference to FIGS. 1-3, the bottom flanges 210 of grid support members 202, 204 each includes a downward facing bottom surface 206 that defines the "grid face" typically visible from the occupied room or space below the grid support system 200 if not concealed. Bottom surface 206 defines a horizontal ceiling reference plane for the overhead grid support system 200. Flange 210 further defines an upward facing top surface 216, which in some embodiments may be used for supporting a portion of the ceiling panels thereon. Longitudinal grid support members 202 may be configured similarly or the same as lateral grid support members 204, or each may be different. Regardless of the configurations used for grid support members 202 and, 204, each may include bottom flanges 210 and downward facing flange surfaces 206 which preferably lie in the same horizontal plane in one embodiment when hung from an overhead building structure. Furthermore, a lower portion of the bottom flanges 201 at the terminal ends 205 of the of lateral grid support members 204 may further be omitted when fabricated or notched/cut off in the field. This facilitates flush mating with the longitudinal edges 214 of longitudinal grid support members 202 and the adjoining grid faces at intersections between longitudinal and lateral grid support members 202, 204 forming a substantially continuous grid face.

Grid support members 202, 204 may be made of any suitable metallic or non-metallic materials structured to support the dead weight or load of ceiling panels 300 without undue deflection. In some non-limiting embodiments, the grid support members may be made of metal including aluminum, titanium, steel, or other. In some non-limiting embodiments, the grid support members 202, 204 may be a standard heavy duty 15/16 inch aluminum T-rail having a 15/16 inch grid face or 9/16 inch T-rail having a narrow 9/16 inch grid face. Other types of grid support members may be used preferably with a sufficiently sized grid face for properly fastening or attaching the ceiling panels thereto.

Features of the ceiling panels mountable on the foregoing ceiling support grid will now be described in further detail. Referring generally to FIGS. 3-10, a plurality of ceiling panels 300 are attached to and supported by the grid support system 200.

Ceiling panels 300 may include grid-concealment features in one embodiment being configured and dimensioned to hide or conceal at least a portion of the ceiling support surface or grid face when mounted to the longitudinal and lateral grid support members 202, 204 of the grid support system 200. Accordingly, ceiling panels 300 may be used to provide a monolithic ceiling appearance which substantially hides the ceiling support or grid surface when viewed from the occupied building space created below, as further described herein. In other embodiments, an intentionally visible gap may be provided between adjoining ceiling panels when hung to reveal a portion of the grid face.

Referring now FIGS. 3-10, ceiling panels 300 may have a generally flattened body with a substantially greater horizontal width W and length L than vertical thickness as shown. Ceiling panel 300 has a body including a top surface 302 facing upward toward the grid support member when mounted, an opposing bottom surface 304, and peripheral edges 306 extending therebetween along the entire perimeter of the ceiling panel on all sides. Top and bottom surfaces 302, 304 may be generally planar and arranged substantially parallel to each other in one non-limiting embodiment. Edges 306 define outward facing peripheral edge surfaces, at least two opposing ones of which in some embodiments are configured to engage the grid support members 202 or 204 of the grid support system 200 for support, as further described herein.

In some embodiments, ceiling panels 300 may have a rectilinear shape, such as without limitation a square with equal length and width peripheral edges 306, or a non-square rectangular shape with unequal length and width peripheral edges. In the latter non-limiting embodiment illustrated in the figures, ceiling panel 300 has a length L extending along corresponding longitudinal edges **306*b* which are larger than a width W extending across corresponding lateral edges 306*a* of the panel. In embodiments where the ceiling panels have a greater length than width, the lateral edges 306*a*** may be considered to define ends of the panel.

In one configuration, the ceiling panels 300 are configured and dimensioned to at least partially or completely hide the grid face of the overhead support grid 209 (i.e. bottom surface 206 of the grid support members 202 and 204). Accordingly, when adjoining ceiling panels 300 are installed in the overhead support grid 209, portions of the opposing lateral edges **306*a* of each panels may each extend partially beneath the horizontal flange bottom surfaces 206 of the two opposing grid support members 202 or 204 which support the ends of the panel (see, e.g. FIGS. 9 and 10**).

Referring generally to FIGS. 3-10, the opposing lateral edges **306*a* of ceiling panel 300 each include an edge feature or profile configured to engage a grid support member 202 or 204 (depending on which direction the ceiling panels are intended to be mounted in the support grid 209). In the illustrated embodiment, the edges 306*a* of the panels 300 are arranged to engage the bottom flanges 210 of lateral grid support members 204. In other possible embodiments, the edges 306*a* may be arranged to engage the flanges of longitudinal grid support members 202**. The invention is expressly not limited to either arrangement.

In one implementation, a first lateral edge **306*a* may have a first edge detail 350 and the opposing lateral edge 306*a* may have a second edge detail 360. Edge detail 350 may be somewhat similar, but different in configuration from edge detail 360 in certain aspects to assist with mounting the ceiling panel 300 in the support grid 209** as further described herein.

Figure 4:
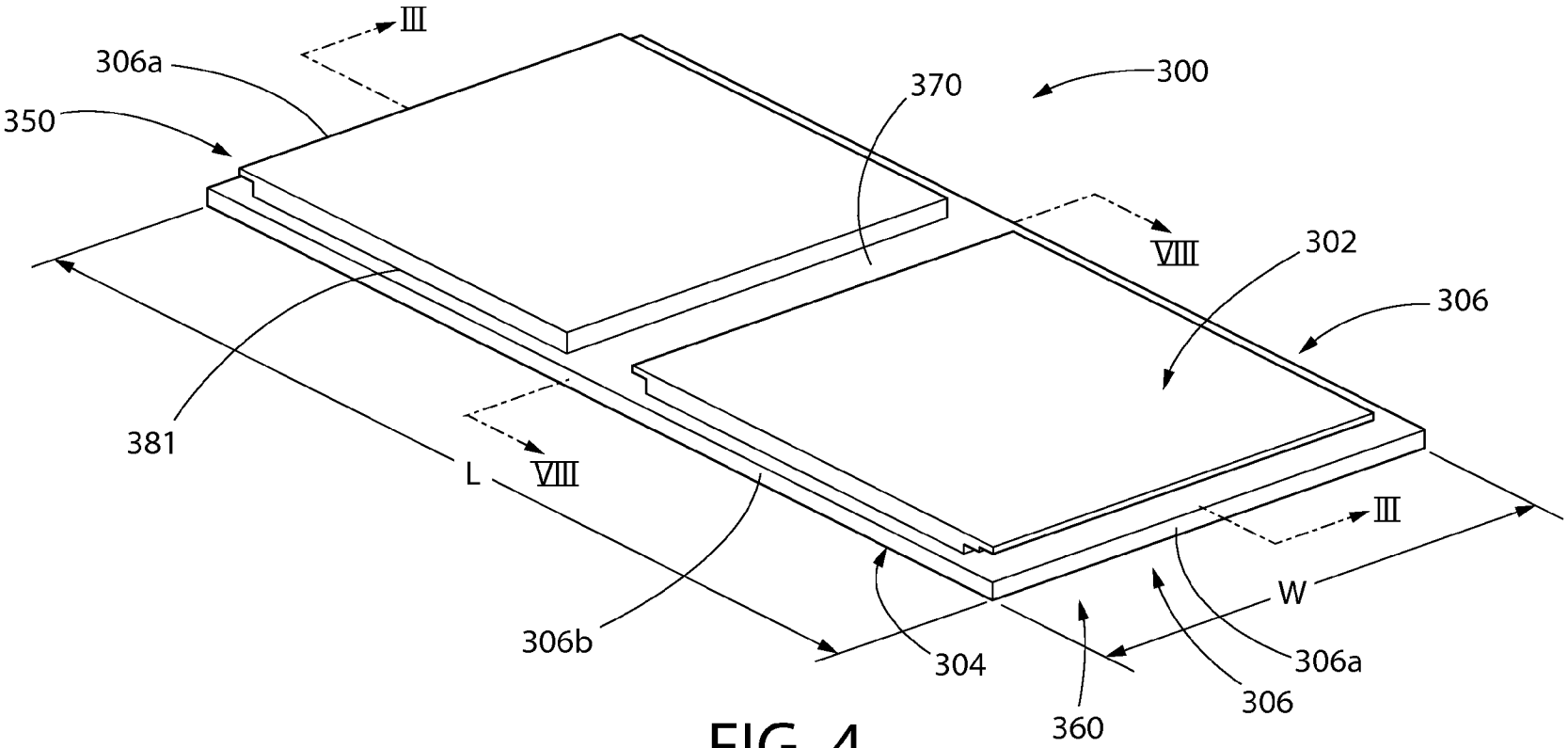
FIG. 4 is a top perspective view of the ceiling panel.
Figure 5:
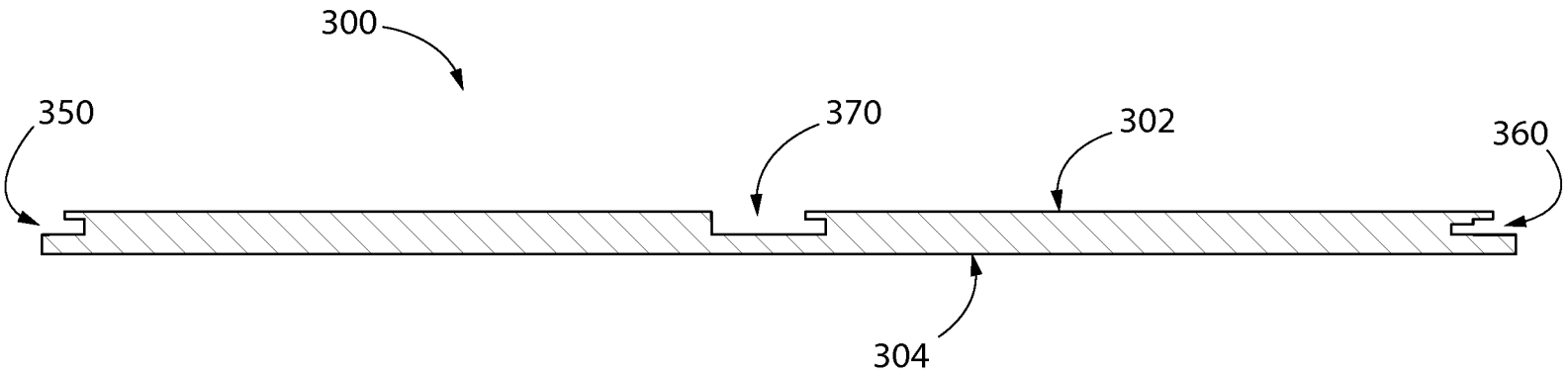
FIG. 5 is side cross-sectional view thereof showing the lateral edges of the panel.
Figure 6:
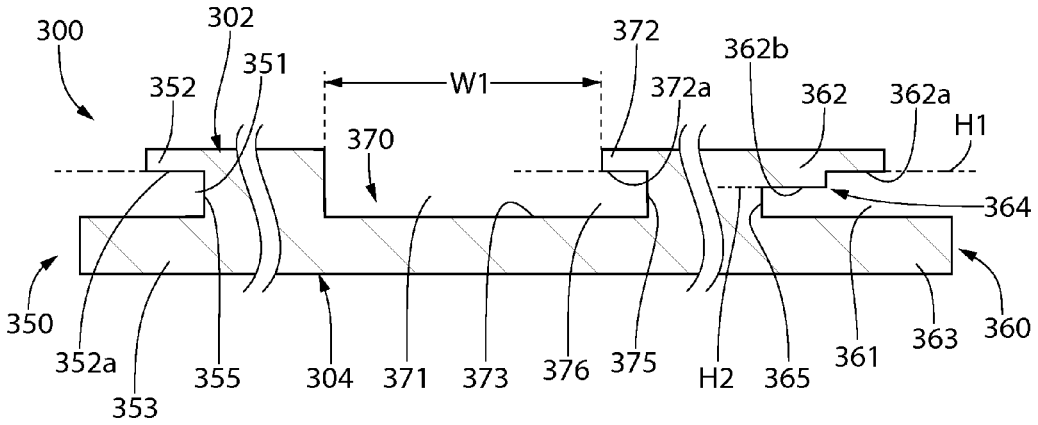
FIG. 6 is enlarged view thereof showing details of the panel mounting features.

Referring to FIGS. 4-6, edge detail 350 of the first lateral edge **306*a* may include an outwardly and laterally open edge channel 351 defined by a cantilevered upper protrusion 352 and a cantilevered lower protrusion 353. Protrusions 352 and 353 protrude outwardly and horizontally from the body of the ceiling panel 300** in a direction substantially parallel to the length L of the panel. In one embodiment, lower protrusion 353 protrudes outwards farther than upper protrusion 352 for positioning beneath the lateral grid support member 204 to conceal a portion of the bottom flange 210 (see, e.g. FIGS. 9 and 10). Upper protrusion 352 defines a downward facing seating surface 352*a* arranged to engage the upward facing top surface 216 on the bottom flange 210 of a first grid support member 204. Channel 351 defines a vertical end wall 355 beneath the upper protrusion 352 at the deepest end portion of the channel.

Edge detail 360 of the second opposing lateral edge 306*a* may similarly include an outwardly and laterally open edge channel 361 defined by a cantilevered upper protrusion 362 and a cantilevered lower protrusion 363. Protrusions 362 and 363 also protrude outwardly and horizontally from the body of the ceiling panel 300 in a direction substantially parallel to the length L of the panel and in an opposite direction than protrusions 352, 353. In one embodiment, lower protrusion 363 protrudes outwards farther than upper protrusion 362 for positioning beneath the lateral grid support member 204 to also conceal a portion of the bottom flange 210 (see, e.g. FIG. 7). Upper protrusion 362 defines a downward facing seating surface 362*a* arranged to engage the upward facing top surface 216 on the bottom flange 210 of a second different grid support member 204 different than the one engaged by the protrusion 352 (see FIGS. 9 and 10 for reference). Channel 361 defines a vertical end wall 365 beneath the upper protrusion 362 at the deepest end portion of the channel.

In one embodiment, the underside of the upper protrusion 362 includes a step feature 364 which defines a second downward facing surface 362*b* deeper within channel 361 proximate to end wall 365. Surface 362*b* also temporarily engages the bottom flange 210 of the second grid support member 204 during the ceiling panel installation. Surface 362*b* lies in a horizontal reference plane H2 lower than the horizontal reference plane H1 coinciding with the level of surfaces 362*a* and 352*a*. Accordingly, surface 362*b* is not coplanar with seating surfaces 362*a*, 352*a*, or 372*a*. The step feature 364 aids in the installation process of the ceiling panel 300, as further described herein.

Referring to FIGS. 4-6, ceiling panel 300 further includes at least one elongated intermediate panel-mounting channel 370 formed in the top surface 302 of the panel. In one embodiment, channel 370 may be located approximately midway between the lateral edges 306*a* of the panel. Channel 370 is preferably oriented parallel to lateral edges 306*a*. Channel 370 is configured and arranged on the top surface to coincide with the location of a third lateral grid support member 204 disposed between the first and second grid support members 204 for engaging the support member (see also FIGS. 9 and 10). Accordingly, in the present embodiment being described, the ceiling panel 300 is supported at three locations by the overhead support grid 209—at each lateral edge 306*a* and in between. This support arrangement is conducive to properly mounting and supporting a large format ceiling panel 300 which spans across at least two grid openings 208 in certain embodiments. In other embodiments using longer ceiling panels spanning across three or more grid openings, additional mounting channels 370 may be provided between the lateral edges 306*a* as needed. In some representative but non-limiting arrangement for long panels, channels may be provided every 2 feet of panel length when lateral grid support members 204 are similarly spaced at 2 foot intervals.

The panel-mounting channel 370 defines surfaces configured to engage the third lateral grid support member 204. In one embodiment, channel 370 includes a mounting detail comprising an upwardly open entrance slot 371, a cantilevered upper protrusion 372, and a bottom surface 373. Protrusion 372 protrudes horizontally from the body of the ceiling panel 300 into the channel 370 in a direction substantially parallel to the length L of the panel. In one configuration, protrusion 372 extends in the same horizontal direction as upper protrusion 352 of the first edge detail 350, but in an opposite direction than upper protrusion 362 of the second edge detail 360. The underside of the upper protrusion 372 defines a downward facing seating surface 372*a* arranged to engage the upward facing top surface 216 on the bottom flange 210 of the third first grid support member 204 (see, e.g. FIGS. 9 and 10). Seating surface 372*a* is coplanar with seating surfaces 362*a* and 352*a*, thereby lying in the same horizontal reference plane H1 so that the ceiling panel 300 will assumed an essentially horizontal position when mounted to the three grid support members 204. A recessed end portion 376 of the channel 370 is formed below and between the bottom of protrusion 372 (i.e. seating surface 372*a*) and the bottom surface 373 of the channel. This defines a vertical end wall 375 beneath the upper protrusion 372 at the deepest end portion of the channel. In some embodiments, channel 370 has an entrance slot with a width W1 which is at least as wide as or preferably slight larger than the horizontal width of the bottom flange of the grid support members 202 or 204 to facilitate insertion of the flange into the recessed end portion 376 of the channel during the panel mounting process.

The channel 370 and edge details 350, 360 may be formed by any suitable fabrication process or combination of processes capable of making the details. Non-limiting examples include cutting, routing, milling, casting, molding, forming, etc. In one embodiment, the mounting channel 370 and edge details 350, 360 may each be continuous and extend across a majority of and substantially the entire width W of the ceiling panel 300 except for the tegular longitudinal edges 306*b* on each side of the panel (see, e.g. FIG. 4).

Ceiling panels 300 may be constructed of any suitable material or combinations of different materials, which in certain embodiments preferably have acoustical properties. Some non-limiting examples of ceiling panel materials that may be used include, without limitation, mineral fiber board, fiberglass, metals, polymers, wood, composites, combinations thereof, or other.

In a preferred but non-limiting embodiment, the panel mounting features described above with respect to the mounting channel 370 are formed as an integral unitary structural part of the ceiling panel body itself rather than being a separate component attached to the top surface 302 of the panel. In this manner, the structural integrity and strength of the panel is not compromised and the possibility of such a separate component becoming detached from the panel is advantageously avoided.

Figure 11:
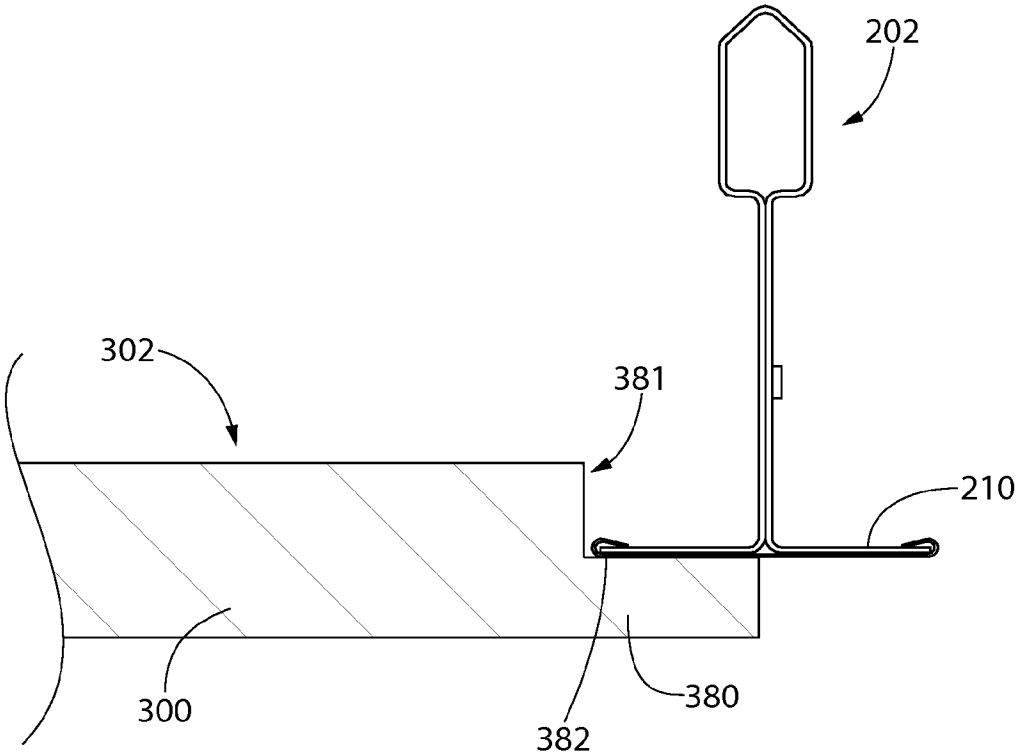
FIG. 11 is a side cross-sectional view of a portion of a longitudinal edge of the ceiling panel.

Referring to FIGS. 4 and 11, the remaining longitudinal edges 306*b* of the ceiling panel 300 may have a tegular edge profile including cantilevered lower protrusions 380 configured and dimensioned to extend beneath the bottom flanges 210 of the longitudinal grid support members 202. The protrusions 380 extend along the length L of the ceiling panel 300. Protrusions 380 extend laterally and horizontally outward from the body of the ceiling panel. An upward facing surface 382 is defined by the protrusion 380 which lies may lie proximate to or contact the bottom surface 206 of the grid support member. The edges 306*b* include a step feature 381 for receiving the bottom flange 201 of the grid support member allowing the flange to access the surface 382. In some embodiments, metal clips such as spring clips may be included which are attached to or partially embedded in the ceiling panels at the step feature 381 to help maintain the panels in close proximity to the grid support member 202 for maintaining a level panel mounting in relation to the lateral edges 306*a*. Any suitable configuration of clips may be used.

Figure 8:
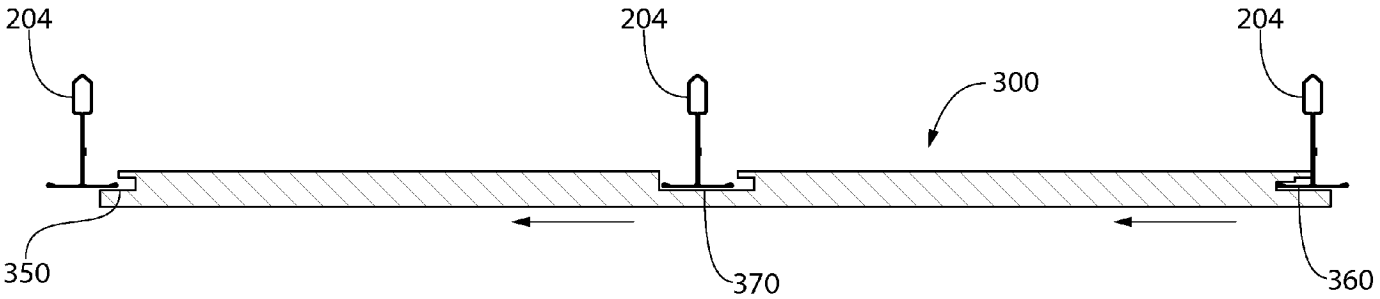
Figure 9:
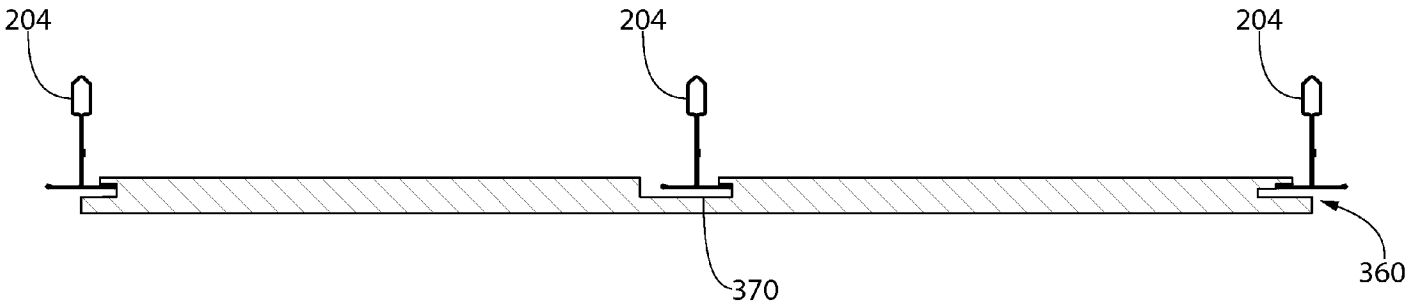
Figure 10:
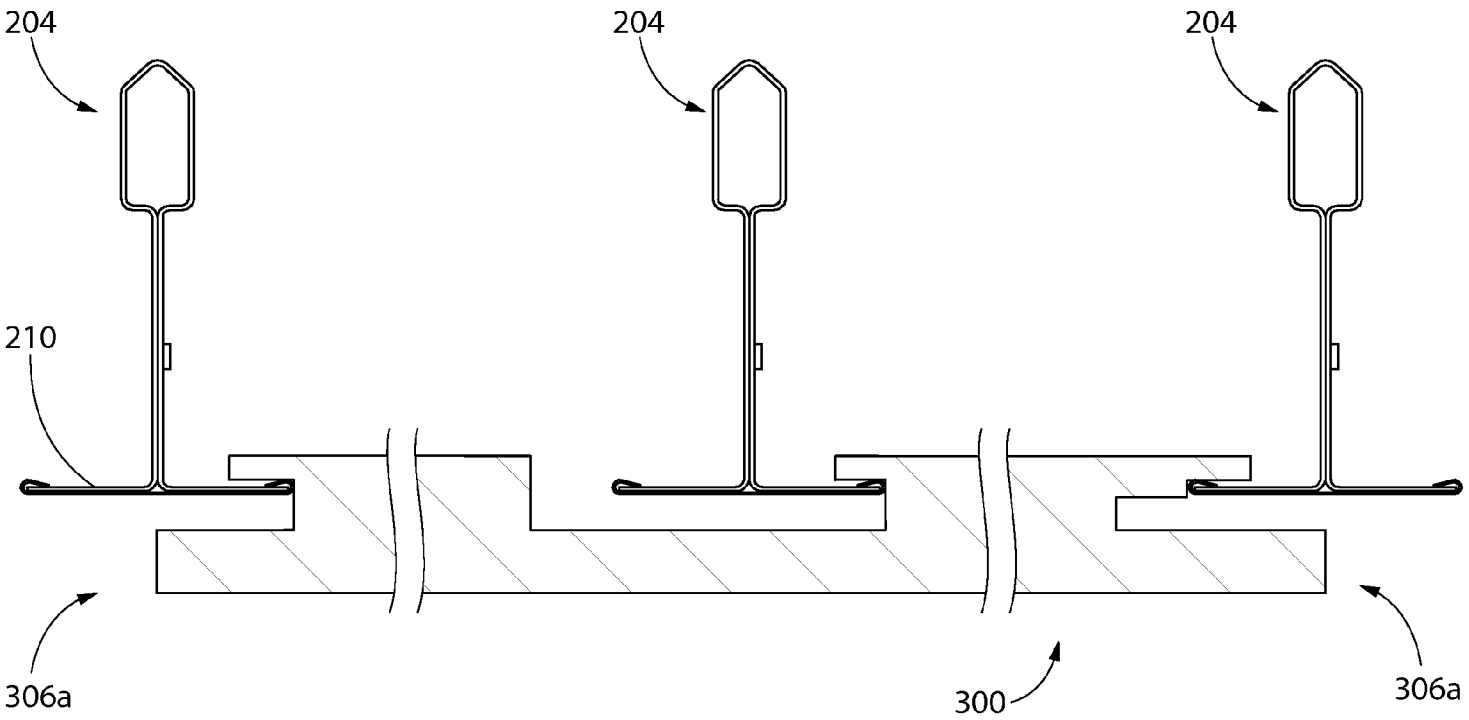
FIG. 10 is an enlarged view of the mounting features of the ceiling panel showing the panel fully mounted on the grid support members.

An exemplary method for installing a ceiling system utilizing large format ceiling panels 300 will now be described. FIGS. 7-9 show sequential steps during the panel installation process.

A grid support system 200 is first installed or already existing having a combination of longitudinal and lateral grid support members 202, 204 arranged in the manner described herein and shown in FIG. 1. For this exemplary method, it will be assumed without limitation that the ceiling panels and the grid openings 208 are non-square rectangular in shape. The same installation methodology may be used if the ceiling panels were square. It will further be assumed that the ceiling panel 300 will be mounted to three lateral grid support members 204; however, the same installation methodology may be used for mounting the panel to longitudinal grid support members 202.

A ceiling panel 300 shown in FIG. 3 is provided for mounting. Referring to FIG. 7, the lateral edge 306*a* with the edge detail 360 (right end of panel in figure) is first engaged with a first grid support member 204 by inserting the bottom flange 210 into channel 361 (see FIG. 7 and directional motion arrow). The ceiling panel 300 is laterally moved in a first axial direction during this motion. During this initial insertion step, the panel 300 is obliquely angled with respect to the bottom grid surface 206 (grid face) of the first grid support member as shown so that the top surface 302 of the ceiling panel 300 is positioned below the flanges 210 of the remaining two grid support members. Preferably, the flange 210 is completely inserted into the channel 361 and positioned between the upper protrusion 362 and lower protrusion 363 until the edge 214 of the flange (identified in FIG. 2) contacts or nearly contacts the end wall 365 in the channel. This deepest portion of channel 361 below surface 362*b* on the upper protrusion is vertically narrower in height than the entrance portion of the channel below surface 362*a*. This helps retain the lateral edge 306*a* in engagement with the grid support member 204 during the remainder of the panel installation process. Also significantly, this properly registers the horizontal position of the ceiling panel 300 so that the middle grid support member 204 shown in FIGS. 7-9 is vertically aligned with the entrance slot 371 of the panel-mounting channel 370 (see, e.g. FIG. 8).

Next, the process continues by pivoting the ceiling panel about the first grid support member (far right in FIG. 7) and raising the lateral edge 306*a* with the edge detail 350 (left end of panel in FIG. 7) upwards to a horizontal position until the lower protrusion 353 engages the bottom flange 210 of a second grid support member 204 (see directional motion arrows). This motion also inserts the bottom flange of the third middle grid support member 204 through the entrance slot 371 and into channel 370 as shown in FIG. 8.

With the ceiling panel 300 in the foregoing position, the ceiling panel is slid preferably all the way to the left in FIG. 8 (see directional motion arrows) in a second axial direction opposite to the first direction. This motion inserts the bottom flange 201 of second grid support member 204 beneath upper protrusion 352 and bottom flange of the third middle grid support member 204 beneath upper protrusion 372 in the channel 370 as seen in FIG. 9 (see also FIG. 6 for general reference). The edges of the second and third grid support member flanges 210 contact and abut end walls 355 and 375 respectively when the panel is fully seated and mounted on the grid support members as shown in FIG. 9. At lateral edge 306*a* having the second edge detail 360 at right in this same figure, the bottom flange 201 on the first grid support member 204 moves from beneath the innermost seating surface 362*b* to the outermost seating surface 362*a* during this same motion. The ceiling panel 300 may then be released, and is fully mounted and supported by the grid support members 204. The top surfaces 216 and/or longitudinal edges 214 on the bottom flanges 210 of the three different grid support members 204 each respectively lockingly engage a corresponding seating surface 352*a*, 362*a*, and 372*a* of the two edge channels 351, 361 and intermediate panel-mounting channel 370 (see also FIG. 10). In this position, the ceiling panel cannot be vertically withdrawn from the support grid 209. Additional panels may be mounted in a similar manner.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A suspended ceiling system comprising:

a ceiling support grid comprising a plurality of intersecting grid support members forming openings between the grid support members;

a plurality of ceiling panels mounted to the grid support members of the support grid, each ceiling panel having a top surface and covering at least two openings, each ceiling panel further comprising profiled first and second edges that engage parallel first and second grid support members respectively and at least one intermediate channel in the top surface between the first and second edges, the intermediate channel defining a seating surface that engages a third grid support member arranged parallel to and between the first and second grid support members.

2. The suspended ceiling system according to claim 1, wherein the first edge comprises and outwardly open first edge channel and the second edge comprises an outwardly open second edge channel, the first edge channel defining a downwardly facing first surface that engages the first grid support member and the second edge channel defining a downwardly facing second surface that engages the second grid support member.

3. The suspended ceiling system according to claim 2, wherein the first and second surfaces of the first and second edge channels each engage horizontal bottom flanges of their respective first and second grid support members.

4. The suspended ceiling system according to claim 1, wherein the grid support members have an inverted T-shape.

5. The suspended ceiling system according to claim 1, wherein the seating surface of the intermediate channel is defined on the underside of a cantilevered upper protrusion that extends into the intermediate channel from the ceiling panel.

6. The suspended ceiling system according to claim 5, wherein the third grid support member includes a bottom flange which is nested within the intermediate channel and partially beneath the upper protrusion.

7. The suspended ceiling system according to claim 6, wherein the intermediate channel includes an upwardly open entrance slot formed in the top surface of the ceiling panel, the entrance slot having a width that is at least as wide as a width of the bottom flange of the third grid support member.

8. The suspended ceiling system according to claim 5, wherein the cantilevered upper protrusion is formed as an integral unitary structural part of the ceiling panel.

9. The suspended ceiling system according to claim 1, wherein the intermediate channel is arranged parallel to the first and second edges of the ceiling panel.

10. A method for mounting a ceiling panel in a suspended ceiling system, the method comprising:

providing a support grid including first, second, and third grid support members arranged in parallel relationship, the third grid support member disposed between the first and second grid support members;

engaging a first edge of a ceiling panel with the first grid support member by moving the ceiling panel in a first axial direction;

pivoting the ceiling panel about the first edge;

raising a second edge of the ceiling panel opposite the first edge upwards to engage the second grid support member;

inserting the third grid support member into an elongated channel formed in a top surface of the ceiling panel between the first and second edges;

sliding the ceiling panel in a second axial direction opposite to the first axial direction; and lockingly engaging a downward facing seating surface defined by each of the first edge, second edge, and channel with the first, second, and third grid support members respectively, wherein the ceiling panel cannot be vertically withdrawn from the support grid.

11. The method according to claim 10, wherein the first, second, and third grid support members each include a bottom flange that engages a respective one of the seating surfaces defined by the first edge, second edge, and channel.

12. The method according to claim 11, wherein bottom flange of the third grid support member is fully inserted into the channel.

* * * * *